US005719112A

United States Patent [19]

Gordon et al.

[11] Patent Number: 5,719,112

[45] Date of Patent: Feb. 17, 1998

[54] DISHWASHING COMPOSITION

[75] Inventors: James William Gordon, Berkel en Rodenrijs, Netherlands; Joseph Oreste Carnali, Pompton Plains, N.J.

[73] Assignee: Lever Brothers Company, Division of Conopco, Inc., New York, N.Y.

[21] Appl. No.: 715,803

[22] Filed: Sep. 18, 1996

Related U.S. Application Data

[63] Continuation of Ser. No. 457,690, Jun. 1, 1995, abandoned.

[30] Foreign Application Priority Data

Jun. 23, 1994 [EP] European Pat. Off. ..... 94201815

[51] Int. Cl.[6] ..... C11D 3/386; C11D 3/37

[52] U.S. Cl. ..... 510/226; 510/221; 510/229; 510/230; 510/233; 510/235; 510/434; 510/475; 510/476; 510/477; 510/478

[58] Field of Search ..... 510/221, 226, 510/229, 230, 233, 235, 434, 475, 476, 477, 478

[56] References Cited

U.S. PATENT DOCUMENTS

| | | | |
|---|---|---|---|
| 4,751,015 | 6/1988 | Humphreys et al. | 252/99 |
| 4,753,748 | 6/1988 | Laitem et al. | 252/99 |
| 5,041,232 | 8/1991 | Batal | 252/94 |
| 5,047,163 | 9/1991 | Batal et al. | 252/102 |
| 5,173,207 | 12/1992 | Drapier et al. | 252/99 |
| 5,232,622 | 8/1993 | Jones et al. | 252/174.24 |
| 5,240,633 | 8/1993 | Ahmed et al. | 252/99 |
| 5,246,612 | 9/1993 | Van Dijk et al. | 252/102 |
| 5,279,756 | 1/1994 | Savio et al. | 252/95 |
| 5,281,352 | 1/1994 | Savio et al. | 252/99 |
| 5,281,356 | 1/1994 | Tsaur et al. | 252/174.13 |
| 5,292,446 | 3/1994 | Painter et al. | 252/99 |
| 5,292,448 | 3/1994 | Klugkist | 252/174.12 |
| 5,308,530 | 5/1994 | Aronson et al. | 252/174.12 |
| 5,318,715 | 6/1994 | Krishman | 252/99 |
| 5,368,766 | 11/1994 | Diait | 252/94 |
| 5,423,997 | 6/1995 | Ahmeo et al. | 252/95 |

FOREIGN PATENT DOCUMENTS

| | | |
|---|---|---|
| 0346995 | 12/1989 | European Pat. Off. . |
| 1296839 | 11/1972 | United Kingdom . |
| 8906279 | 7/1989 | WIPO . |
| 9108280 | 6/1991 | WIPO . |
| 9321299 | 10/1993 | WIPO . |

OTHER PUBLICATIONS

M. L. Anson, "Journal of General Physiology" vol. 27 p. 79 (1938).

P. Bernfeld, "Method of Enzymology" vol. 2 p. 149 (1955).

112/Cosmetics & Toiletries, vol. 108, May 1993 (Attachment I).

Shulman, Jan E.; "*Non–phosphate ADDS,* " happi Jul. 1992, second page referring to Tables II and III. (Attachment II).

*Primary Examiner*—Paul Lieberman
*Assistant Examiner*—Kery Fries
*Attorney, Agent, or Firm*—A. Kate Huffman

[57] ABSTRACT

The invention provides a dishwashing composition comprising builder material, buffer material and other conventional ingredients in combination with a lipase and a hydrophobic modified (co)polymer of acrylic acid. More in particular the invention provides a dishwashing composition comprising lipase (calculated as having an activity of 200 LU/mg) and a hydrophobic modified (co)polymer of acrylic acid in a weight ratio of 1 to 1:2.000, preferably 1 to 1:1 000.

9 Claims, No Drawings

DISHWASHING COMPOSITION

This is a continuation application of Ser. No. 08/457,690, filed Jun. 1, 1995, now abandoned.

This invention relates to dishwashing compositions useful for automatic dishwashing and their preparation. Dishwashing compositions are well-known in the art and numerous patents exist in this field. Automatic dishwashing compositions exist in various forms and especially in the form of powders and various particulate forms such as granulate, coarse powder, tablets and noodles. Dishwashing compositions are normally made up from various ingredients like builder material, buffer material, suspending agent like polymeric materials, bleaching agent/activator, corrosion inhibitor, surfactant, foam depressor, enzyme such as amylase, protease, filler, perfume etc.

Especially automatic dishwashing compositions comprising major amounts of builder material, buffer material, bleaching agent and enzymes (protease and amylase) have found wide application. One of the disadvantages of such products is often that glasses when washed with such a composition show an undesirable spotty appearance. The addition of another enzyme type—lipase—can prevent this occurring. Unfortunately this enzyme causes white deposits to build up on hydrophobic surfaces such as plastic. These deposits are apparently due to precipitation of calcium soaps on these articles which are formed and precipitated during the washing process from calcium ions introduced by the "hardness" of tap water and fatty acids liberated by the action of lipase on fatty (triglyceride) contaminants of the "dishes". The problem is worse when the "dishes" are heavily contaminated with fatty foodstuffs.

It has now been found that the occurrence of spots on glass and plastic dishes etc can be prevented or at least suppressed by using a dishwashing composition comprising builder material, buffer material and other conventional ingredients which also comprises a lipase and a hydrophobic modified (co)polymer of especially acrylic acid.

Under a lipase is here to be understood an enzyme which is a biochemical catalyst capable of permitting a reaction to quickly occur and enzymes can be classified according to the type of reaction they catalyse. Enzymes are characterized by a high specificity, that is to say, each enzyme can catalyse a single reaction of one substance or a very small number of closely related substances. Lipases are enzymes catalysing the degradative hydrolysis of various types of lipids. They facilitate the degradation or alteration of biochemical soils and stains, especially lipids encountered in cleansing situations so as to remove more easily the soil or stain from the object being washed, or they make the soil or stain more removable in a subsequent cleansing step. Both degradation and alteration can improve soil removability. Lipases are classified as EC class 3, hydrolases, subclass EC 3.1, preferably carboxylic ester hydrolases EC 3.1.1. An example thereof are lipases EC 3.1.1.3 with the systematic name glycerol ester hydrolases. Other enzymes are also frequently used in dish washing compositions they are discussed more fully below.

Lipases, sometimes called esterases, hydrolyse fatty soils. Lipases suitable for use herein include those of animal, plant and microbiological origin. Suitable lipases are also found in many strains of bacteria and fungi. For example, lipases suitable for use herein can be derived from Pseudomonas, Aspergillus, Pneumococcus, Staphylococcus, Toxins, Mycobacterium Tuberculosis, Mycotorula Lipolytica, and Sclerotinia microorganisms, and can be made using recombinant DNA manufacturing techniques.

Suitable animal lipases are found in the body fluids and organs of many species. A preferred class of animal lipase herein are the pancreatic lipases.

Lipase can be employed with advantage in the present cleaning compositions in a ratio of lipase granules (calculated as having an activity of 200 LU/mg) to a hydrophobic modified (co)polymer of especially acrylic acid (as defined below) in a weight ratio of 1 to 1:2 000, preferably 20 to 1:1 000. Lipases of this activity are commercially available and if the activity of material employed deviates, the amount actually used is recalculated to the amount of enzyme preparation having an activity of 200 LU/mg and the effect this has on the total weight quantity is ignored. The activity of lipase expressed in LU/mg is determined according to NOVO publication 95/5.

Under a hydrophobic modified (co)polymer of acrylic acid is to be understood a member of a particular group of polymeric compounds either acid and/or salt of the group consisting of polycarboxylic acid polymers. Suitable polycarboxylic acid polymers comprise. e.g. a water-soluble homopolymer or copolymer having a molecular weight of at least 500 up to over 800,000, preferably from about 3.000 to 500,000 on average (GPC-method). It may be derived from a monocarboxylic acid or from a di-, tri- or polycarboxylic acid. The polymer will normally be used in the form of its water-soluble alkali metal salt form. One group of polymer materials found to be of value comprises homopolymers derived from a monomer of the formula:

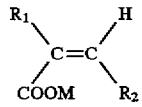

wherein $R_1$ is hydrogen, hydroxyl, $C^1$-$C^4$ alkyl or alkoxy, acetoxy, or —$CH_2COOM$; $R^2$ is hydrogen, $C^1$-$C^4$ alkyl or —COOM and M is an alkalimetal. Examples of this group include the sodium and potassium salts of polyacrylic, polymethacrylic, polyitaconic, polymaleic and polyhydroxyacrylic acids and also the hydrolysis products of the corresponding polymerised acid anhydrides. A second group of suitable polymeric materials comprises the copolymers of two or more carboxylic monomers of the above formula. Examples of this group include the sodium and potassium salts of copolymers of maleic anhydride with acrylic acid, methacrylic acid, crotonic acids, itaconic acid and its anhydride and/or aconitic acid. A third group of suitable polymeric materials comprises the copolymers of one carboxylic monomer of the above formula and two or more non-carboxylic acid monomers such as ethylene, propylene, styrene, alpha-methylstyrene, acrylonitrile, acrylamide, vinylacetate, methylvinylketone, acrolein and esters of carboxylic acid monomers such as ethyl acrylate and methacrylate. Preferably the polymeric material is a (co)polymer of acrylic acid, more preferably a copolymer also containing methacrylate groups. Suitable polymers for the purpose of this invention are hydrophobic modified (co)polymers of acrylic acid which also contain hydrophillic modifications. Consequently they usually contain small amounts of relatively hydrophobic units, e.g. those derived from polymers having a solubility of less than 1 g/l in water. Examples of suitable relatively water insoluble polymers are polyvinylacetate, polymethylmethacrylate, polyethylacrylate, polyethylene, polypropylene, polystyrene, polybutylene, polyisobutylene, polypropylene oxide, polyhydroxy propyl acetate.

Very useful for the purpose of the present invention are hydrophobic modified (co)polymers of acrylic acid containing hydrophobic $C_8$ - $C_{24}$ alkyl or alkenyl groups as side-chains. Preferably the hydrophobic modified (co)polymer of acrylic acid also contains poly $C_2$ - $C_3$ alkoxy groups, more preferably the average number of $C_2$ - $C_3$ alkoxy groups in each polyalkoxy group is from 0 to 30, most preferably 10 to 25. Ideally the hydrophobic $C_8$ - $C_{24}$ alkyl or alkenyl groups are attached to the polymer backbone by an esterified carboxyl group of (meth)acrylic acid optionally via poly $C_2$ - $C_3$ alkoxy groups. In a further embodiment the hydrophobic modified (co)polymer of acrylic acid contains from 0.01 to 0.5 hydrophobic alkyl and/or alkenyl groups per carboxyl group. In a further preferred embodiment the hydrophobic modified (co)polymer of acrylic acid has a ratio of polyalkoxy groups to alkyl or alkenyl groups from 0.01 to 100, preferably from 0.1 to 10.

This type of polymeric materials is more fully disclosed in European Patent Application (EP-A-) 346 995 (Unilever—Montague et al) which is incorporated herein by reference.

A very preferred type of polymers are acrylates/steareth-20-methacrylate copolymers which are more fully disclosed in 112/Cosmetics & Toiletries 108, May 1993. Polymers of this type are inter alia available from Rohm and Haas Company, Spring House, Pa., USA under the tradename Acusol, such as Acusol 820 (MW 500,000) and 460 ND (MW 15,000). Acusol 820 was previously available as Acrysol ICS-1. Similar products are available as Norasol from Norsohaas, Werneuil en Halatte, France. The compounds are known as thickeners for detergents and cosmetic preparations at percentage levels especially at pH levels above 7.0. (Steareth derivatives are derived from technical grade stearic acid, which is usually a mixture of about equal parts of stearic acid and palmitic acid.)

In a preferred embodiment the present invention provides a dishwashing composition comprising:

- 10–90% (w.w.) of a dishwashing base composition consisting of 10–90% (w.w.) of builder material of the class consisting of alkali metal tripolyphosphate; alkali metal salt of di-, tri- or tetracarboxylic acid and polycarboxylate polymer and 90–10% (w.w.) of buffer material of the class consisting of alkali metal silicate; alkali metal (bi)carbonate and sesquicarbonate;
- 0.01–10% (w.w.) of lipase (calculated as having an activity of 200 LU/mg);
- 0.5–20% (w.w.) of hydrophobic modified (co)polymer of acrylic acid;
- 3–70% (w.w.) of conventional ingredients comprising bleaching agent/activator, corrosion inhibitor, surfactant, foam depressor, enzyme such as amylase, protease, filler, dye and perfume.

Builder material of the class consisting of alkali metal tripolyphosphate; any alkali metal salt of di-, tri- or tetracarboxylic acid and polycarboxylate polymer, the latter is, however, not a hydrophobically modified polymer of acrylic acid of the type discussed above. Certain phosphate replacing builders may be present such as zeolites, nitrilotriacetic acid etc. An alkali metal salt of di-, tri- or tetracarboxylic acid is especially an alkali metal salt of an acid like citric acid, mellitic acid, oxydisuccinic acid, carboxymethoxysuccinic acid, malonic acid, dipicolinic acid, alkenyl succinic acid etc. Part of the di-, tri- and tetracarboxylic acid e.g. 30% can be replaced by a lower hydroxymonocarboxylic acid e.g. lactic acid. Partial salts of the carboxylic acid in which one or more of the hydrogen ions of the carboxylic groups are replaced by metal ions are particularly useful. Especially sodium and potassium salts can be used with good results for the purpose of this invention. Potassium salts are sometimes preferred because of their higher solubilty. The use of alkali metal citrate, especially sodium citrate in the dish washing compositions according to the present invention is preferred. The use of sodium oxydisuccinate is also preferred.

The buffer material used according to the present invention comprises preferably an alkali metal silicate. The use of sodium silicate with a composition satisfying $SiO_2$:$Na_2O$= 1.0–3.3, preferably 1.8–2.3, is particularly recommended. Other alkali silicates can, however, also be used. Alkali metal disilicates, in particular sodium disilicate is used with special advantage. The buffer material may further comprise any alkali metal carbonate/bicarbonate/sesquicarbonate, with a preference for sodium compounds. One of the advantages of incorporating such an inorganic salt is that it increases the solubility of the dishwashing compositions because these salts dissolve rapidly and thereby convert the particulate material to an open sponge-like structure so that the surface area of the granule is increased which leads to an increase of the solubility.

In the dish washing composition according to the invention all of the inorganic salts are usually present in the form of their lower stable hydrate(s). The composition is, however, calculated on the basis of dry, anhydrous material.

More preferably the dishwashing composition according to the present invention comprises:

- 30–80% (w.w.) of a dishwashing base composition consisting of 20–80% (w.w.) of builder material of the class consisting of alkali metal tripolyphosphate; alkali metal salt of di-, tri- or tetracarboxylic acid and polycarboxylate polymer and 80–20% (w.w.) of buffer material of the class consisting of alkali metal silicate; alkali metal (bi)carbonate and sesquicarbonate;
- 0.1–5% (w.w.) of lipase (calculated as having an activity of 200 LU/mg);
- 1–6% (w.w.) of hydrophobic modified (co)polymer of acrylic acid;
- 5–50% (w.w.) of conventional ingredients comprising bleaching agent/activator, corrosion inhibitor, surfactant, foam depressor, enzyme such as amylase, protease, filler, dye and perfume.

The conventional ingredients present in the dishwashing compositions according to the present invention comprise inter alia:

A bleach system may be encapsulated. The bleach system may be a chlorine- or bromine-releasing agent or a peroxygen compound. Among suitable reactive chlorine- or bromine-oxidizing materials are heterocyclic N-bromo- and N-chloro imides such as trichloroisocyanuric, tribromoisocyanuric, dibromoisocyanuric and dichloroisocyanuric acids, and salts thereof with water-solubilizing cations such as potassium and sodium. Hydantoin compounds such as 1,3-dichloro-5,5-dimethyl-hydantoin are also quite suitable.

Dry, particulate, water-soluble anhydrous inorganic salts are likewise suitable for use herein such as lithium, sodium or calcium hypochlorite and hypobromite. Chlorinated trisodium phosphate is another suitable material. Chloroisocyanurates are, however, the preferred bleaching agents. Potassium dichloroisocyanurate is sold by Monsanto Company as ACL-59®. Sodium dichloroisocyanurates are also available from Monsanto as ACL-60®, and in the dihydrate form, from the Olin Corporation as Clearon CDB-56®, available in powder form (particle diameter of less than 150 microns); medium particle size (about 50 to 400 microns); and coarse particle size (150–850 microns). Very large particles (850–1700 microns) are also found to be suitable also for encapsulation.

Other bleaches which are preferably not encapsulated and included in granular form are: organic peroxy acids or the precursors thereof. The peroxyacids usable in the present invention are solid and, preferably, substantially water-insoluble compounds. By "substantially water- insoluble" is meant herein a water-solubility of less than about 1% by weight at ambient temperature. In general, peroxyacids containing at least about 7 carbon atoms are sufficiently insoluble in water for use herein.

Typical monoperoxy acids useful herein include alkyl peroxy acids and aryl peroxyacids such as:

(i) peroxybenzoic acid and ring-substituted peroxybenzoic acids, e.g. peroxy-alpha-naphthoic acid;

(ii) aliphatic and substituted aliphatic monoperoxy acids, e.g. peroxylauric acid and peroxystearic acid;

(iii) phthaloyl amido peroxy caproic acid (PAP).

Typical diperoxy acids useful herein include alkyl diperoxy acids and aryldiperoxy acids, such as:

(iv) 1,12-diperoxydodecanedioic acid (DPDA);

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid.

Peroxyacid bleach precursors are well known in the art. As non-limiting examples can be named N,N,N',N'-tetraacetyl ethylene diamine (TAED), sodium nonanoyloxybenzene sulphonate (SNOBS), sodium benzoyloxybenzene sulphonate (SBOBS) and the cationic peroxyacid precursor (SPCC) as described in U.S. Pat. No. 4,751,015.

Inorganic peroxygen-generating compounds are also suitable. Examples of these materials are salts of monopersulphate, perborate monohydrate, perborate tetrahydrate, and percarbonate.

If desirably a bleach catalyst, such as the manganese complex, e.g. Mn—Me TACN, as disclosed in EP-A-0 458 397, or the sulphonimines of U.S. Pat. Nos. 5,041,232 and 5,047,163, is to be incorporated.

Furthermore a corrosion inhibitor may be present. Alkali metalsilicates are employed as cleaning ingredients, as a source of alkalinity, metal corrosion inhibitor and protector of overglaze on china table ware. Sodium silicate is preferred for these purposes, but potassium silicate may be used e.g. to provide an additional source of potassium ions and to maintain homogeneity. Other corrosion inhibitors may also be used.

A surfactant may also be present in the dish washing compositions according to the present invention. Preferably this is a small amount of low- to non-foaming nonionic surfactant, which includes any alkoxylated nonionic surface-active agent wherein the alkoxy moiety is selected from the group consisting of ethylene oxide, propylene oxide and mixtures thereof, is preferably used to improve the detergency and to suppress excessive foaming due to some protein soil. However, an excessive proportion of nonionic surfactant should be avoided. Normally, an amount of 0.1 to 5% by weight, preferably from 0.5 to 4% by weight, is quite sufficient. Examples of suitable nonionic surfactants for use in the invention are the low- to non-foaming ethoxylated straight-chain alcohols of the Plurafac® RA series, supplied by the Eurane Company; of the Lutensol® LF series, supplied by the BASF Company and of the Triton® DF series, supplied by the Rohm & Haas Company.

In case a substantial amount of surfactant and/or an enzyme is present in the dishwashing compositions according to the present invention this may also comprise a foam depressor. Various foam depressors are known in the art such as silicon oil, paraffins, petroleum jelly, ketone-fatty alcohol mixtures etc. Dosage levels are usually 0.1 to 5% w.w. based on the dish washing composition.

The organic phosphonates which can be present in the dish washing composition according to the present invention are e.g. the various organic polyphosphonates, e.g. of the Dequest® range, which are especially added to phosphate-free machine dishwashing compositions. A drawback of these polymers is that some of them are not quite biodegradable and therefore environmentally less acceptable. Therefore some of the polyphosphonates, whilst being effective, are less acceptable as being P-containing products.

The dish washing composition according to the present invention may not only contain the enzyme lipase discussed above, but other enzymes may also be used dependent on the type of reaction which should be catalysed. Examples of enzymes suitable for use in the cleaning compositions of this invention include not only lipases, but also peptidases, amylases (amylolytic enzymes) and others which degrade, alter or facilitate the degradation or alteration of biochemical soils and stains encountered in cleansing situations so as to remove more easily the soil or stain from the object being washed to make the soil or stain more removable in a subsequent cleansing step. Both degradation and alteration can improve soil removability. Well-known and preferred examples of these additional enzymes are especially proteases and amylases. Amylases belong to the same general class as lipases (discussed above), subclass EC 3.2, especially EC 3.2.1 glycose hydrolases such as 3.2.1.1. alpha-amylase with the systematic name alpha-1,4-glucan-4-glucanohydrolase; and also 3.2.1.2, beta-amylase with the systematic name alpha-1,4-glucan maltohydrolase. Proteases belong to the same class as lipases and amylases, subclass EC 3.4, particularly EC 3.4.4 peptide peptidohydrolases such as EC 3.4.4.16 with the systematic name subtilopeptidase A.

Obviously, the foregoing classes should not be used to limit the scope of the invention. Enzymes serving different functions can also be used in the practice of this invention, the selection depending upon the composition of biochemical soil, intended purpose of a particular composition, and the availability of an enzyme to degrade or alter the soil.

The enzymes most commonly used in machine dishwashing compositions are amylolytic and proteolytic enzymes. The amylolytic enzymes for use in the present invention can be those derived from bacteria or fungi. Preferred amylolytic enzymes are those prepared and described in British Patent Specification (GB-A-) 1,296,839, cultivated from the strains of *Bacillus licheniformis* NCIB 8061, NCIB 8059, ATCC 6334, ATCC 6598, ATCC 11 945, ATCC 8480 and ATCC 9945 A. Examples of such amylolytic enzymes are amylolytic enzymes produced and distributed under the trade name of SO-95® or Termamyl® by Novo Industri A/S, Copenhagen, Denmark. These amylolytic enzymes are generally presented as granules and may have enzyme activities of from about 2 to 10 Maltose units/milligram. The amylolytic activity can be determined by the method as described by P. Bernfeld in "Method of Enzymology", Vol. I (1955), page 149.

Examples of suitable proteolytic enzymes are the subtilisins which are obtained from particular strains of *B. subtilis* and *B. licheniformis*, such as the commercially available subtilisins Maxatase®, supplied by Gist-Brocades N. V., Delft, Holland, and Alcalase®, supplied by Novo Industri A/S, Copenhagen, Denmark.

Particularly suitable is a protease obtained from a strain of Bacillus having maximum activity throughout the pH range of 8–12, being commercially available from Novo Industri A/S under the registered trade names of Esperase® and Savinase®. The preparation of these and analogous enzymes is described in GB-A-1 243 784.

Another suitable protease useful herein is a commercial product sold by Novo Industri A/S under the trade name Durazym®, as described in WO-A-89/06279. The enzymes are generally presented as granules, e.g. marumes, prills, T-granules etc., and may have enzyme activities of from about 500 to 1700 glycine units/milligram. The proteolytic activity can be determined by the method as described by M. L. Anson in "Journal of General Physiology", Vol. 22 (1938), page 79 (one Anson Unit/g=733 Glycine Units/milligram).

All of these additional enzymes can each be present in a weight percentage amount of from 0.2 to 5%, such that for amylolytic enzymes the final composition will have amylolytic activity of from $10^2$ to $10^6$ Maltose units/kg, and for proteolytic enzymes the final composition will have proteolytic enzyme activity of from $10^6$ to $10^9$ Glycine Units/kg.

Additional optional minor ingredients are the well-known enzyme stabilizers such as the polyalcohols, e.g. glycerol, and borax; anti-scaling agents; crystal-growth inhibitors, threshold agents; thickening agents and the like.

The dish washing composition according to the present invention can be prepared by various methods. E.g. the process may involve preparing a slurry of the ingredients identified above and drying the mixture by means of suitable equipment e.g. a turbine dryer. Suitable equipment is e.g. a Turbogranulation drier ex Vomm-Turbo Technology, Vomm Impianti E Processi SrL, Milan, Italy. Also the process may involve preparing a slurry of the ingredients, spray-drying the slurry by conventional technique using a spray tower in which the slurry is atomized and dried in a hot air stream, followed by restructuring the resulting powder,optionally after milling, in a granulation process e.g. using a Lödige recycler and a Lödige plow shear. In a particularly favourable process the slurry is sprayed onto fine (recycled) particles and dried to form gradually growing co-granules.

Another attractive possibility is to dry the slurry in a rotary drum granulator and to spray slurry onto (recirculated) fines building up coarser particles followed by, or in conjunction with drying. These spray-on techniques lead to co-granules with a homogeneous distribution of moisture, better than e.g. those obtained by the use of a turbine dryer and consequently they yield co-granules of a better solubility.

The invention is now illustrated by the following non-limiting examples. All parts and percents mentioned are on a weight basis unless indicated otherwise.

EXAMPLE I

The following machine dish washing composition was prepared:

| Composition | Parts by weight |
|---|---|
| Lipase (Lipolase 100T, ex NOVO, 200 LU/mg) | 0.8 |
| Hydrophobic modified (co)polymer of acrylic acid | 2.2 |
| Sodium citrate dihydrate | 39.2 |
| Sodium disilicate containing 20% $H_2O$ | 34 |
| Sodium perborate monohydrate | 8.9 |
| TAED, bleach activator | 3.4 |

-continued

| Composition | Parts by weight |
|---|---|
| Acrylic acid/maleic acid copolymer* | 4.3 |
| Acrylic acid homopolymer** | 2 |
| Protease (Savinase 6 T, ex NOVO, 1629 GU/mg) | 2 |
| Amylase (Termamyl 60T, ex NOVO, 4.3 MU/mg) | 1.5 |
| Nonionic (Plurefac LF 403, ex BASF) | 1.7 |

*a non-hydrophobic modified copolymer, Sokalan CP 5, ex BASF.
**Sokalan PA 30 CL, ex BASF The hydrophobic modified (co)polymer of acrylic acid was respectively:

1.) Acusol 820, ex Rohm & Haas a copolymer with $C_{18}$ and with $EO_{20}C_{18}$ side chains, about 500 000 MW, ex Rohm & Haas;

2.) Acusol 460, copolymer of diisobutylene and maleic acid, 15 000 MW, ex Rohm & Haas;

3.) Carbopol 1342, copolymer of acrylic acid and 3% long chain alkyl methacrylate, 1 300.000 MW, ex BF Goodrich;

4.) Pemulen TR 1, copolymer of acrylic acid and 10% long chain alkyl methacrylate, 1 300.000 MW, ex BF Goodrich;

5.) Narlex LD 55, copolymer of acrylic acid and 10% of a $EO_8$ methacrylate ester, ex National Starch;

6.) Sokalan PA 30 CL, polyacrylic acid homopolymer, 8 000 MW, ex BASF;

7.) Sokalan PA 110, polyacrylic acid homopolymer 250 000 MW, ex BASF.

Machine dishwashing experiments were carried out with the above formulations 1.) through 7.) at a product dosage level of 12 g per run (3.0 g/L) in an AEG OKO-FAVORIT 575 machine at a water intake of 4 liters (16° FH.). The wash program consisted of a pre-wash, main wash at 55° C., an intermediate rinse and a final rinse at 65° C. The load per wash consisted of three 10×10 cm squares of 5 mm thick high density polyethylene sheeting which were placed in the upper rack. This material was found to be an excellent substrate for calcium soap deposition. As a soil, 4 g of cream butter (1 g/L) was melted in hot water and added to the machine just prior to the main wash. Butter, with its high content of saturated triacylglycerols, is known to give serious deposition problems. At the end of the total wash cycle, the plates were removed from the machine and scored from 1 to 5 according to the following scheme: 1=no deposit, 2=just perceptible deposit, 3=light deposit, 4=medium deposit, 5=heavy deposit (equivalent to no additive). The results are tabulated below:

| Polymeric additive (2.2%) | Deposition score |
|---|---|
| 1.) Acusol 820 | 2 |
| 2.) Acusol 460 ND | 3 |
| 3.) Carbopol 1342 | 4 |
| 4.) Pemulen TR 1 | 4 |
| 5.) Narlex LD 55 | 4 |
| 6.) Sokalan PA 30 CL | 5 |
| 7.) Sokalan PA 110 S | 5 |

As can be seen polyacrylic acid homopolymers [additives 6. ) and 7. )] give no reduction in the deposition of the calcium soaps. Hydrophobic modification via the attachment of pendant alkyl chains to the polyacrylate backbone [additives 3.) and 4.)], give a perceivable reduction in the amount of deposition. The same is true of hydrophillic modification via polyethylene oxide pendant groups

[additive 5.)]. Copolymerization of a hydrophobic monomer along with acrylic acid [additive 2.)] yielded a significant reduction in the deposition and combined hydrophillic and hydrophobic modification of the polyacrylate backbone as found in additive 1.) almost completely eliminated soap deposition at the 2.2% usage level.

EXAMPLE II

In this example, a determination of the dose/response behaviour of a few of the polymeric additives is obtained. The wash runs with the polyethylene monitors were done as in Example 1 but with incremental doses of the additives. The results, expressed in the same 1–5 rating scheme described above were:

| | level (%) | | | |
|---|---|---|---|---|
| Additive | 0 | 1 | 3 | 5 |
| Acusol 820 [1.)] | 5 | 3 | 2 | 2 |
| Acusol 460 [2.)] | 5 | 3 | 3 | 2 |
| Sokalan Pa 110 S [7.)] | 5 | 5 | 4 | 3 |

It can be seen that additive 1.) gave a progressive benefit in terms of incremental reduction in soap deposition with increasing use level. Additive 2.) gave a rapid threshold benefit already at 1%, but the score then improved only slowly at higher polymer dosages. Lastly, polyacrylic acid homopolymer [additive 7.)] gave a very weak response with concentration.

EXAMPLE III

In this example the glass appearance benefits afforded by a formulation containing lipase and polymer additive are illustrated. The formulation described in Example I, minus the hydrophobically modified polymer, and referred to below as formulation 1b, and some variations were used along with the washing conditions described above. The load in this case consisted of 5 clean milk glasses and a load of cups, saucers and plates soiled in a standard way with dried-on egg and starch. After the wash run, the glasses were visually assessed for residual spots according to the following 1 through 5 scoring scheme: 1=zero spots, 2=1 to 5 spots per glass, 3=6 to 10 spots per glass, 4=11 to 20 spots per glass, 5=more than 20 spots per glass. The average spot score of the glasses washed with each formulation variant was found to be:

| Formulation variant | spot score |
|---|---|
| Formulation 1b minus Lipolase | 4 |
| Formulation 1b | 1 |
| Formulation 1b plus 2.2% of additive 1.) | 1 |
| Formulation 1b plus 2.2% of additive 2.) | 1 |
| Formulation 1b minus Lipolase plus additive 1.) | 3 |
| Formulation 1b minus Lipolase plus additive 2.) | 3 |

Evidently the presence of Lipolase in the formulation was critical for a low spot score on glasses. The presence of the polymeric additives 1.) and 2.) maintained this good glass appearance while preventing deposition of calcium soap deposits. The polymers themselves, however, contributed very little to the glass appearance.

EXAMPLE IV

The following dishwashing composition was prepared:

| Composition | Parts by weight |
|---|---|
| Sodium citrate dihydrate | 40 |
| Sodium disilicate containing 20% $H_2O$ | 26.8 |
| Sodium perborate monohydrate | 15.5 |
| TAED, bleach activator | 1.2 |
| Acrylic acid/maleic acid copolymer* | 4.9 |
| Protease (Savinase 6 T, ex NOVO, 1629 GU/mg) | 1.9 |
| Manganese bleach catalyst (2% granule)** | 3.9 |
| Amylase (Termamyl 60T, ex NOVO, 4.3 MU/mg) | 1.2 |
| Nonionic (Plurefac LF 403, ex BASF) | 1.9 |
| Lipase (Lipolase 100T, ex NOVO, 200 LU/mg) | 0.8 |
| Hydrophobic modified (co)polymer of acrylic acid (Acusol 820, ex Rohm & Haas) | 2.2 |

*a non-hydrophobic modified copolymer, Sokalan CP 5, ex BASF.
**Mn—Me TACN, as disclosed in EP-A-0 458 397.

8.) No additive. (i.e. no hydrophobic modified (co) polymer of acrylic acid.)

Machine dishwashing experiments were carried out as described in Example I, but with a dosage of 2.5 g/L, with formulations containing polymeric additive 1.) or no additive 8.) The deposition scores, obtained exactly according to the procedure of the above Example were 2 and 5 for additives 1.) and 8.) respectively. Thus the additive 1.) was effective in preventing deposition of calcium soaps in this overall formulation as well.

We claim:

1. A dishwashing composition useful for inhibiting deposition of calcium soap on tableware during a washing process comprising:
   a) 10–90 wt. % of a dishwashing base formulation comprising:
      i) 10–90 wt. % of a builder material selected from the group consisting of alkali metal tripolyphosphate, alkali metal salts of di-, tri-, tetracarboxylic acid and polycarboxylate polymer;
      ii) 90–10 wt. % of a buffer material selected from the group consisting of alkali metal silicate, alkali metal (bi)carbonate and sesquicarbonate;
   b) 0.01–10 wt. % of a lipase calculated as having an activity of 200 LU/mg;
   c) 0.5–20 wt. % of a hydrophobic modified (co)polymer of both an alkyl methacrylate group having a carbon chain length of 8 to 24 carbon atoms and an alkali metal salt of acrylic acid, said polymer also having alkoxylated hydrophilic modifications; and
   d) 3–70 wt. % of an additive ingredient selected from the group consisting of a bleaching agent, a bleaching activator, a corrosion inhibitor, a surfactant, a foam depressor, an amylase, a protease, a filler, a dye, a perfume and mixtures thereof.

2. A dishwashing composition useful for inhibiting deposition of calcium soap on tableware durinq a washing process according to claim 1 consisting of:
   a) 30–80 wt. % of a dishwashing based composition comprising:
      i) 20–80 wt. % of a builder material selected from the group consisting of an alkali metal tripolyphosphate, an alkali metal salt of di-, tri- or tetracarboxylic acid and polycarboxylate polymer, and
      ii) 80–20 wt. % of a buffer material selected from the group consisting of an alkali metal silicate, alkali metal (bi)carbonate and sesquicarbonate.
   b) 0.1–5 wt. % of a lipase calculated as having an activity of 200 LU/mg;

c) 1–6 wt. % of a hydrophobic modified (co)polymer of both an alkyl methacrylate group having a carbon chain length of 8 to 24 carbon atoms and an an alkali metal salt of acrylic acid, said polymer also having alkoxylated hydrophilic modifications; and d) 5–50 wt. % of an additive selected from the group consisting of a bleaching agent, a bleaching activator, a corrosion inhibitor, a surfactant, a foam depressor, an amylase, a protease, a filler, a dye, a perfume and mixtures thereof.

3. A dishwashing composition according to claim 1 wherein comprising an alkali metal salt of a di-, tri- or tetracarboxylic acid.

4. A dishwashing composition according to claim 1 wherein the alkali metal salt of a di-, tri- or tetracarboxylic acid comprises an alkali metal citrate.

5. A dishwashing composition according to claim 1 wherein the alkali metal salt of a di-, tri- or tetracarboxylic acid comprises an alkali metal oxydisuccinate.

6. A dishwashing composition according to claim 1 wherein the polycarboxylate is based on acrylate groups or on a mixture of acrylate and methacrylate.

7. A dishwashing composition according to claim 1 wherein the alkali metal silicate is sodium silicate with a composition satisfying $SiO_2:Na_2O=1.0–3.3$.

8. A dishwashing composition according to claim 1 wherein the alkali metal silicate is alkali metal disilicate.

9. A dishwashing composition according to claim 7 wherein the alkali metal silicate is sodium silicate with a composition having a ratio of $SiO_2:Na_2O=1.8–2.3$.

* * * * *